US011529660B2

(12) United States Patent
Bergmann et al.

(10) Patent No.: US 11,529,660 B2
(45) Date of Patent: Dec. 20, 2022

(54) ROLLING OF A ROLLED MATERIAL

(71) Applicant: Primetals Technologies Austria GmbH, Linz (AT)

(72) Inventors: Martin Bergmann, Linz (AT); Konrad Krimpelstaetter, Gailneukirchen (AT)

(73) Assignee: Primetals Technologies Austria GmbH, Linz (AT)

( * ) Notice: Subject to any disclaimer, the term of this patent is extended or adjusted under 35 U.S.C. 154(b) by 0 days.

(21) Appl. No.: 17/607,514

(22) PCT Filed: Apr. 23, 2020

(86) PCT No.: PCT/EP2020/061368

§ 371 (c)(1),
(2) Date: Oct. 29, 2021

(87) PCT Pub. No.: WO2020/221654

PCT Pub. Date: Nov. 5, 2020

(65) Prior Publication Data

US 2022/0143662 A1 May 12, 2022

(30) Foreign Application Priority Data

Apr. 30, 2019 (EP) ..... 19171923

(51) Int. Cl.
*B21B 45/02* (2006.01)
*B21B 1/32* (2006.01)

(52) U.S. Cl.
CPC ..... *B21B 45/0215* (2013.01); *B21B 1/32* (2013.01); *B21B 45/0248* (2013.01); *B21B 45/0218* (2013.01); *B21B 45/0251* (2013.01)

(58) Field of Classification Search
CPC ..... B21B 45/0209; B21B 45/0218; B21B 45/0233; B21B 45/0251; B21B 1/32;
(Continued)

(56) References Cited

U.S. PATENT DOCUMENTS 9,815,101 B2 * 11/2017 Krimpelstätter ..... B21B 15/005

FOREIGN PATENT DOCUMENTS

CN 107838197 A * 3/2018 ..... B21B 27/10
EP 2651577 B1 10/2013
(Continued)

OTHER PUBLICATIONS

Hauret, Translation of WO-2006054781 (Year: 2006).*
(Continued)

*Primary Examiner* — Adam J Eiseman
*Assistant Examiner* — Bobby Yeonjin Kim
(74) *Attorney, Agent, or Firm* — Liang & Hennessey LLP; Brian Hennessey

(57) ABSTRACT

The invention relates to a method and a rolling device for rolling a rolled material. The rolled material is guided through a roll gap between two working rollers of a reversing roll stand, alternatingly in two opposing rolling directions. A lubricant for lubricating a contact zone is introduced into the contact zone in which the rolled material is in contact with the working rollers, and a coolant is applied to the rolled material and/or the working rollers. In a mixture with a carrier gas, the lubricant is sprayed onto the working rollers and/or onto the rolled material exclusively on an outlet side of a pass. The coolant is applied to the working rollers and/or to the rolled material exclusively on an inlet side of a pass.

17 Claims, 2 Drawing Sheets

(58) Field of Classification Search
CPC ..... B21B 1/34; B21B 1/36; B21B 2027/103; B21B 27/10
See application file for complete search history.

(56) References Cited

FOREIGN PATENT DOCUMENTS

| | | | | | |
|---|---|---|---|---|---|
| EP | 3092088 | B1 | | 11/2016 | |
| EP | 3461566 | A1 | | 4/2019 | |
| RU | 2212962 | C2 | | 9/2003 | |
| SU | 1235585 | A1 | | 6/1986 | |
| WO | WO-2006054781 | A1 | * | 5/2006 | ..... B21B 37/00 |
| WO | 2013029886 | A1 | | 3/2013 | |

OTHER PUBLICATIONS

Wang, Translation of CN-107838197 (Year: 2018).*
International Search Report and Written Opinion received in International Application No. PCT/EP2020/061368 dated Sep. 9, 2020, pp. 14.
Decision to Grant received in Russian Application No. 2021125447/05(053764) dated Oct. 27, 2022, pp. 20.

* cited by examiner

ROLLING OF A ROLLED MATERIAL

CROSS-REFERENCE TO RELATED APPLICATIONS

The present application is a national phase application of PCT Application No. PCT/EP2020/061368, filed Apr. 23, 2020, entitled "ROLLING OF A ROLLED MATERIAL", which claims the benefit of European Patent Application No. 19171923.6, filed Apr. 30, 2019, each of which is incorporated by reference in its entirety.

BACKGROUND OF THE INVENTION

1. Field of the Invention

The invention relates to a method for rolling a rolled material using a reversing roll stand, and relates to a rolling apparatus for rolling a rolled material using a reversing roll stand.

2. Description of the Related Art

In a reversing roll stand, a rolled material is guided alternatingly in two mutually opposite rolling directions through a roll gap between two rotating working rollers in order to reduce the thickness of the rolled material. The rolled material is a usually metallic rolled strip. A pass of the rolled material through the roll gap is referred to as a rolling pass. During the first rolling pass, the rolled material runs in this case into the roll gap with a relatively high pickling roughness, which is subsequently smoothed further in each subsequent rolling pass. The friction of the rolled material with the working rollers is accordingly high in the first rolling passes. This results in high rolling forces and negative effects of the rolling abrasion on the strip cleanliness of the rolled material. Excessively high rolling forces in the reversing roll stand may lead to a higher number of required rolling passes and thus to longer production times. Excessively high coefficients of friction may also have the effect that particularly thin products cannot be produced at all, since from a certain thickness of the rolled material no further reduction in thickness is possible owing to the elastic deformation of the rollers. Poor strip cleanliness results in reduced product quality (in the case of a cold-rolled end product) or additional outlay in the subsequent machining steps (in the case of an annealed and/or galvanized end product). In order to reduce the friction of the rolled material with the working rollers, the roll gap is usually lubricated. Furthermore, the working rollers are usually cooled, in order to reduce the temperature and the wear of the working rollers.

EP 2 651 577 B1 discloses a method and an apparatus for applying a lubricant during the rolling of a metallic rolled strip, which is guided through in a roll gap between two working rollers. In this case, a mixture of the lubricant and a carrier gas is generated in an atomization device, and the mixture is applied to the surface of at least one working roller and/or to the surface of the rolled strip by means of spray nozzles.

EP 3 092 088 B1 discloses a method and an apparatus for applying a lubricating oil during the rolling of a metallic flat rolled material in a roll stand. To this end, the lubricating oil is atomized by means of compressed air to form an aerosol which is sprayed onto the rolled material and/or at least one roller of the roll stand by means of a plurality of spray nozzles which are arranged next to one another.

WO 2013/029886 A1 discloses a reversing rolling mill, wherein strip-like rolled material is guided in a sequence of passes with alternating running-through direction through a reversing roll stand and, after each pass, is coiled up on a coiler, wherein pure rolling oil in the form of an oil/air mixture is sprayed onto the rolled material with the aid of apparatuses arranged between the reversing roll stand and the respective coiler. In this case, the application of rolling oil is carried out separately from an application of coolant to the working rollers and/or the rolled material in a work step that precedes the respective rolling pass. As a result thereof and as a result of the homogenization, which takes place during each coiling operation, of the lubricant located on the rolled material, the quantity of rolling oil used can be advantageously reduced.

SUMMARY OF THE INVENTION

The invention relates to a method for rolling a rolled material using a reversing roll stand, wherein the rolled material is guided alternatingly in two mutually opposite rolling directions through a roll gap between two working rollers of a reversing roll stand. A lubricant, for example a lubricating oil, for lubricating a contact zone is introduced into the contact zone in which the rolled material bears against the working rollers, and a coolant is applied to the rolled material or/and the working rollers. The lubricant is dispensed in a mixture with a carrier gas, wherein the mixture is sprayed onto the working rollers or/and onto the rolled material exclusively on a run-out side of a rolling pass, on which run-out side the rolled material runs out of the roll gap.

The invention furthermore relates to a rolling apparatus for rolling a rolled material using a reversing roll stand, comprising

- a reversing roll stand with two working rollers,
- at least one spraying bar, which is configured to spray the mixture of the lubricant and the carrier gas onto a working roller or/and onto the rolled material,
- at least one cooling bar, which is configured to dispense the coolant onto a working roller or/and onto the rolled material, and
- a control unit, which is configured to control each spraying bar in such a way that the mixture of the lubricant and the carrier gas is dispensed exclusively on a run-out side of a rolling pass.

The invention is based on the object of specifying an improved method and an improved rolling apparatus for rolling a rolled material using a reversing roll stand.

The object is achieved according to the invention by a method and a rolling apparatus having the features of the claims.

Advantageous embodiments of the invention are the subject of the dependent claims.

In the method according to the invention for rolling a rolled material, the coolant is dispensed onto the working rollers or/and onto the rolled material exclusively on a run-in side of a rolling pass, on which run-in side the rolled material runs into the roll gap. Since in each case two successive rolling passes have different rolling directions, the run-in side of one rolling pass is a side of the reversing roll stand that is the run-out side of the subsequent rolling pass, and the run-out side of one rolling pass is a side of the reversing roll stand that is the run-in side of the subsequent rolling pass.

In other words, the invention provides that a rolled material, during rolling in a reversing roll stand, is lubricated with a lubricant only on the run-out side and is cooled with a coolant only on the run-in side, wherein the lubricant is sprayed onto the working rollers or/and onto the rolled material in a mixture (aerosol) with a carrier gas. The lubricant is preferably applied only to the working rollers because less lubricant is thereby discharged from the reversing roll stand, which reduces the lubricant consumption. The application of the lubricant by spraying the working rollers or/and the rolled material with a mixture of the lubricant and a carrier gas has the advantage, for example compared with the application of a lubricating emulsion, that the lubricant can be applied in a highly targeted manner only to certain surface regions of the working rollers or/and of the rolled material, in order to concentrate the application of lubricant to the contact zone in which the rolled material in the roll gap bears against the working rollers. As a result, in particular the lubrication can be reduced to a minimum quantity lubrication with a minimum lubricant quantity.

The dispensing of coolant only on the run-in side onto the working rollers or/and onto the rolled material prevents relatively large quantities of the coolant from being discharged on the run-out side from the reversing roll stand, which may occur especially in the case of relatively high rolling speeds of the rolled material on account of the inertia of the coolant. The spraying of the working rollers or/and of the rolled material with the mixture of the lubricant and the carrier gas only on the run-out side takes account of the fact that in the case of a run-in-side spraying and a simultaneous run-in-side dispensing of coolant onto the working rollers or/and onto the rolled material, the coolant can prevent the mixture of the lubricant and the carrier gas from reaching the working rollers or/and the rolled material. Advantage is taken here of the fact that lubricant which is applied by spraying the working rollers or/and the rolled material with the mixture of the lubricant and the carrier gas adheres to the working rollers or/and to the rolled material better than for example a lubricant which is applied with an emulsion, with the result that lubricant does not need to be applied on the run-in and run-out sides since lubricant applied on the run-out side also acts on the run-in side on account of its adhesion.

The coolant used is for example water or a cooling emulsion. The cooling emulsion contains, for example, a rolling oil in a proportion of less than ten percent by volume of the cooling emulsion. It is also possible for the coolant to contain at least one emulsifier, which prevents the demixing of the components (for example water and rolling oil) of the cooling emulsion and improves the adhesion of the lubricant to the working rollers or/and to the rolled material. Compared with the use of a cooling emulsion, the use of pure water as coolant has the advantage that the temperature of the coolant can be kept lower than in the case of emulsion cooling (a cooling emulsion requires a certain minimum temperature), as a result of which the cooling action is improved. In the case of pure water cooling, the outlay (installation, ongoing operating costs) for the production and reprocessing of the cooling emulsion is also dispensed with. By adding an emulsifier which improves the adhesion of the lubricant to the working rollers or/and to the rolled material, it is advantageously possible to further reduce the lubricant requirement.

Provision may also be made for the mixture of the lubricant and the carrier gas to be sprayed onto the working rollers or/and onto the rolled material only when the rolled material is being guided through the roll gap in one of the two rolling directions. As a result, spraying bars for dispensing the mixture need be arranged only on one side of the reversing roll stand.

As an alternative, provision may be made for the mixture of the lubricant and the carrier gas to be sprayed onto the working rollers or/and onto the rolled material when the rolled material is being guided through the roll gap in both rolling directions. This requires spraying bars for dispensing the mixture on both sides of the reversing roll stand, but makes more flexible lubrication possible since in each required rolling pass lubricant can be applied on the run-out side to the working rollers or/and to the rolled material.

Provision may also be made that when the rolled material is being guided through the roll gap for the first time (that is to say during the first rolling pass), a rolled material head of the rolled material, which is the first region of the rolled material to be guided through the roll gap, is guided through the roll gap at a slower speed than the remaining region of the rolled material. In this case, provision may furthermore be made that when the rolled material head is being guided through the roll gap for the first time, no coolant is dispensed onto the working rollers or/and onto the rolled material. In this embodiment of the invention, the slower guiding of the rolled material head through the roll gap during the first rolling pass results in a cooling requirement that is not as high as when being guided through at a higher speed. As a result, it is possible to dispense with cooling during the threading of the rolled material into the reversing roll stand. This is generally not a problem since the rolled material head usually has a reduced quality in any case and is therefore scrapped.

In the case of a rolling apparatus according to the invention for carrying out the method according to the invention, the control unit is configured to control each cooling bar in such a way that the coolant is dispensed exclusively on a run-in side of a rolling pass.

A rolling apparatus according to the invention makes it possible to carry out the method according to the invention. The advantages of a rolling apparatus according to the invention therefore correspond to the advantages of the method according to the invention already mentioned above.

In one embodiment of the rolling apparatus, all the spraying bars are arranged on the same side of the reversing roll stand. Compared with an arrangement of spraying bars on both sides of the reversing roll stand, this embodiment of the rolling apparatus saves on space, complexity and costs and takes account of the fact that owing to the good adhesion, already discussed above, of the lubricant to the working rollers or/and to the rolled material, it is generally possible to dispense with a lubricating operation for each rolling pass.

In a further embodiment of the rolling apparatus, at least one spraying bar and at least one cooling bar are arranged on at least one side of the reversing roll stand.

In a further embodiment of the rolling apparatus, on at least one side of the reversing roll stand, at least one spraying bar is arranged above a rolled material plane, in which the rolled material is guided, and at least one spraying bar is arranged below the rolled material plane. It is also possible, on at least one side of the reversing roll stand, for at least one cooling bar to be arranged above the rolled material plane and at least one cooling bar to be arranged below the rolled material plane. These embodiments of the rolling apparatus advantageously make it possible to lubricate and/or cool the working rollers or/and the rolled material on both sides of the rolled material.

BRIEF DESCRIPTION OF THE DRAWINGS

The above-described properties, features and advantages of this invention, and the manner in which these are achieved, will become clearer and more clearly comprehensible in conjunction with the following description of exemplary embodiments, which will be discussed in more detail in conjunction with the drawings, in which.

Mutually corresponding parts are provided with the same reference designations in the figures.

DETAILED DESCRIPTION

Figure 1:
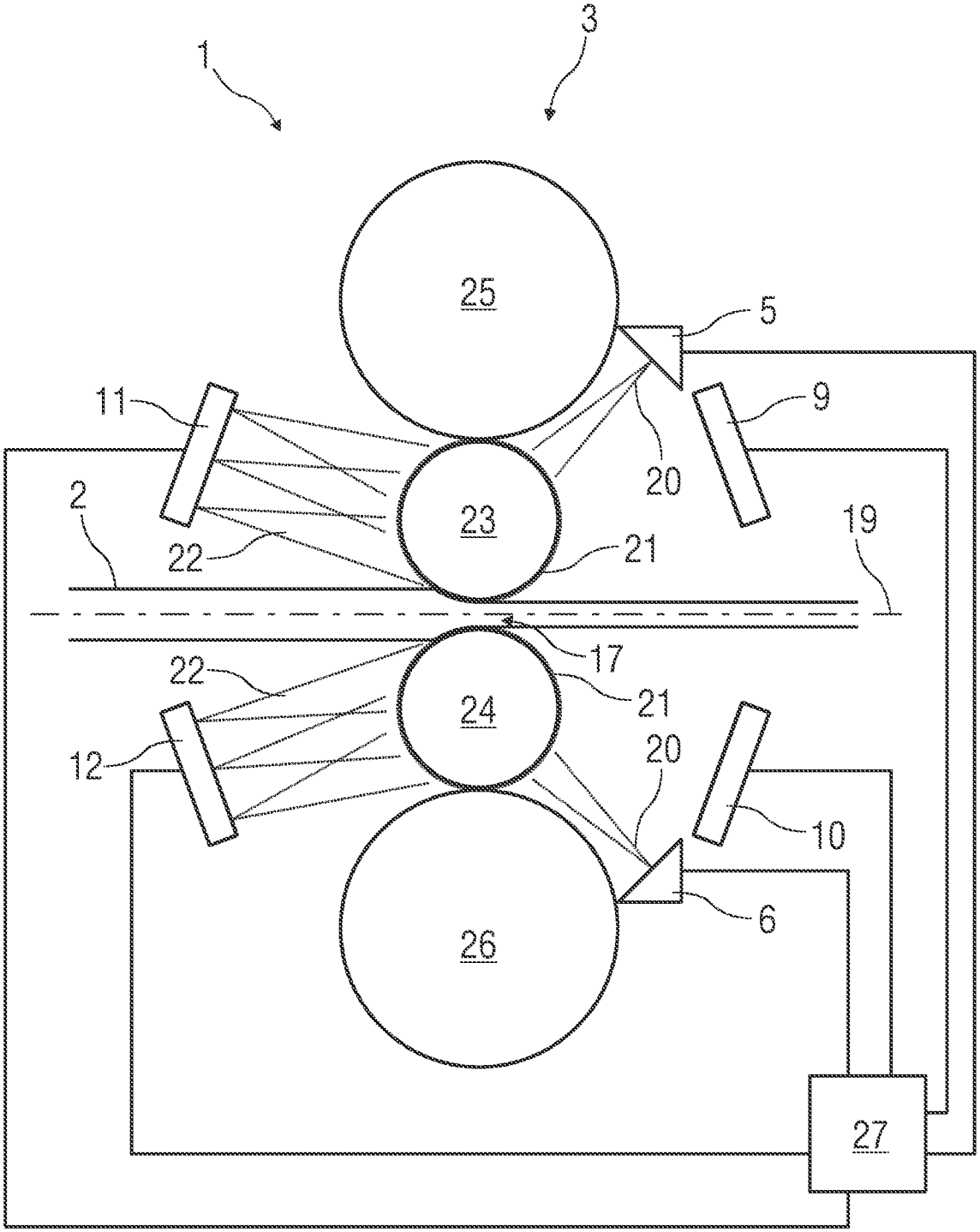
FIG. 1 schematically shows a side view of a first exemplary embodiment of a rolling apparatus according to the invention, and FIG. 2 schematically shows a side view of a second exemplary embodiment of a rolling apparatus according to the invention.

FIG. 1 schematically shows a side view of a first exemplary embodiment of a rolling apparatus 1 according to the invention for rolling a rolled material 2. The rolled material 2 is a metallic rolled strip, for example a steel strip, the thickness of which is reduced by the rolling. The rolling apparatus 1 comprises a reversing roll stand 3, two spraying bars 5, 6, four cooling bars 9 to 12 and a control unit 27.

The reversing roll stand 3 has two working rollers 23, 24 which are arranged one above the other and two back-up rollers 25, 26, wherein one back-up roller 25 is arranged above the two working rollers 23, 24 and the other back-up roller 26 is arranged below the two working rollers 23, 24. The two working rollers 23, 24 are spaced apart from one another by a roll gap 17.

In order to roll the rolled material 2, the working rollers 23, 24 are set in rotation and the rolled material 2 is guided by the rotating working rollers 23, 24 alternatingly in two mutually opposite rolling directions through the roll gap 17. FIG. 1 shows a rolling pass in which the rolled material 2 is guided from left to right through the roll gap 17, such that the left-hand side of the reversing roll stand 3 is the run-in side of the rolling pass and the right-hand side of the reversing roll stand 3 is the run-out side of the rolling pass. In the subsequent rolling pass, the rolled material 2 is guided from right to left through the roll gap 17, such that the right-hand side of the reversing roll stand 3 is the run-in side of the rolling pass and the left-hand side of the reversing roll stand 3 is the run-out side of the rolling pass.

The spraying bars 5, 6 are arranged on one side of the reversing roll stand 3, wherein one spraying bar 5 is arranged above a rolled material plane 19, in which the rolled material 2 is guided, and the other spraying bar 6 is arranged below the rolled material plane 19. Each spraying bar 5, 6 is configured to spray a mixture 20 (aerosol) of a lubricant 21, for example a lubricating oil, and a carrier gas onto the surface of a working roller 23, 24. To produce the mixture 20, each spraying bar 5, 6 has an atomization device (not illustrated in any more detail) to which the lubricant 21 and the carrier gas are supplied and which atomizes the lubricant 21 in the carrier gas. To dispense the mixture 20, each spraying bar 5, 6 has spray nozzles (likewise not illustrated in any more detail) which are configured to spray the mixture 20 onto the surface of a working roller 23, 24.

The cooling bars 9 to 12 are arranged on both sides of the reversing roll stand 3, wherein, on each side of the reversing roll stand 3, a cooling bar 9, 11 is arranged above the rolled material plane 19 and a cooling bar 10, 12 is arranged below the rolled material plane 19. Each cooling bar 9 to 12 is configured to dispense a coolant 22 onto a surface of a working roller 23, 24 or/and a surface of the rolled material 2. To this end, each cooling bar 9 to 12 has, for example, spray nozzles (not illustrated in any more detail) by means of which the coolant 21 can be dispensed. The coolant 22 is for example water or a cooling emulsion containing water and a rolling oil, wherein the oil content of the cooling emulsion is less than ten percent by volume. The coolant 22 may also contain at least one emulsifier, which improves the adhesion of the lubricant 21 to the working rollers 23, 24 or/and to the rolled material 2.

The spraying bars 5, 6 and the cooling bars 9 to 12 can be controlled by the control unit 27. The control unit 27 is configured to control the spraying bars 5, 6 and the cooling bars 9 to 12 in such a way that the mixture 20 is sprayed onto the working rollers 23, 24 exclusively on the run-out side of a rolling pass and the coolant 22 is dispensed onto the working rollers 23, 24 or/and onto the rolled material 2 exclusively on the run-in side of a rolling pass. Since the spraying bars 5, 6 are arranged only on one side of the reversing roll stand 3 in the exemplary embodiment shown in FIG. 1, it is thus the case in this exemplary embodiment that the mixture 20 is only sprayed onto the working rollers 23, 24 at most in every second rolling pass.

Preferably, during the first rolling pass, a rolled material head of the rolled material 2, which is the first region of the rolled material 2 to be guided through the roll gap 17, is also guided through the roll gap 17 at a slower speed than the remaining region of the rolled material 2, and when the rolled material head is being guided through the roll gap 17 for the first time, no coolant 22 is dispensed onto the working rollers 23, 24 or/and onto the rolled material 2.

Figure 2:
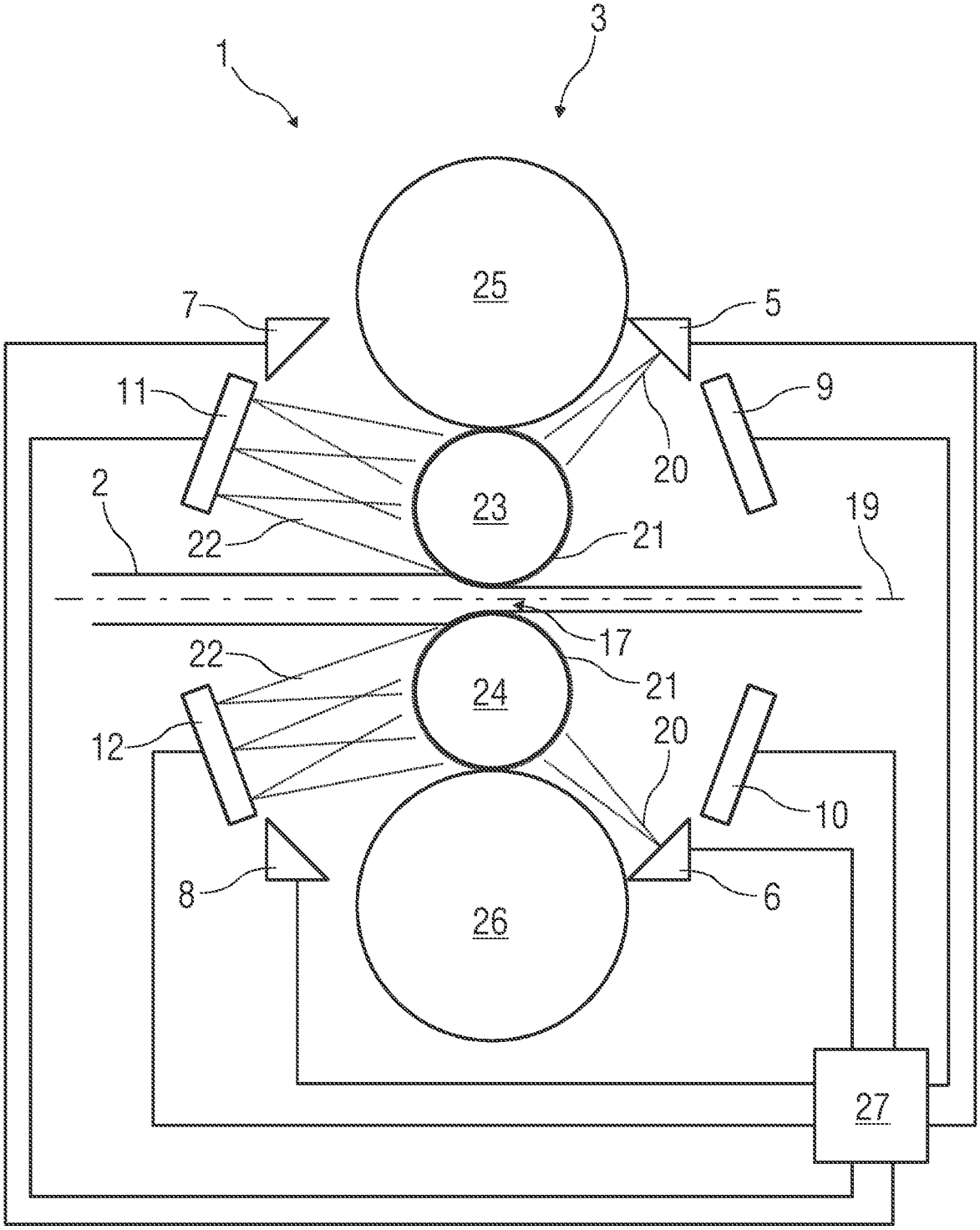

FIG. 2 schematically shows a side view of a second exemplary embodiment of a rolling apparatus 1 according to the invention for rolling a rolled material 2. This exemplary embodiment differs from the first exemplary embodiment shown in FIG. 1 merely by the number and arrangement of spraying bars 5 to 8. In the second exemplary embodiment, on each side of the reversing roll stand 3, a spraying bar 5, 7 and a cooling bar 9, 11 are arranged above the rolled material plane 19 and a spraying bar 6, 8 and a cooling bar 10, 12 are arranged below the rolled material plane 19.

In analogy to the first exemplary embodiment, the control unit 27 is configured to control the spraying bars 5 to 8 and the cooling bars 9 to 12 in such a way that the mixture 20 is sprayed onto the working rollers 23, 24 exclusively on a run-out side of a rolling pass and the coolant 22 is dispensed onto the working rollers 23, 24 or/and onto the rolled material 2 exclusively on a run-in side of a rolling pass. Since spraying bars 5 to 8 are arranged on both sides of the reversing roll stand 3 in the exemplary embodiment shown in FIG. 2, in contrast to the exemplary embodiment shown in FIG. 1, the mixture 20 can be sprayed onto the working rollers 23, 24 in each rolling pass. Like FIG. 1, FIG. 2 shows a rolling pass in which the rolled material 2 is guided from left to right through the roll gap 17, such that the run-in side of the rolling pass is the left-hand side of the reversing roll stand 3 and the run-out side of the rolling pass is the right-hand side of the reversing roll stand 3. Accordingly, during this rolling pass, the working rollers 23, 24 are sprayed with the mixture 20 only by the spraying bars 5, 6 arranged to the right of the reversing roll stand 3 and the coolant 22 is dispensed onto the working rollers 23, 24 and/or the rolled material 2 only by the cooling bars 11, 12 arranged to the left of the reversing roll stand 3.

Although the invention has been illustrated and described in more detail on the basis of preferred exemplary embodiments, the invention is not restricted by the examples disclosed, and other variations can be derived therefrom by a person skilled in the art without departing from the scope of protection of the invention.

LIST OF REFERENCE DESIGNATIONS

1 Rolling apparatus
2 Rolled material
3 Reversing roll stand
5 to 8 Spraying bars
9 to 12 Cooling bars
17 Roll gap
19 Rolled material plane
20 Mixture
21 Lubricant
22 Coolant
23, 24 Working roller
25, 26 Back-up roller
27 Control unit

The invention claimed is:

1. A method for rolling a rolled material, comprising:
guiding the rolled material alternatingly in two mutually opposite rolling directions through a roll gap between two working rollers of a reversing roll stand;
introducing a lubricant for lubricating the two working rollers;
applying a coolant to at least one of the two working rollers and the rolled material;
wherein the lubricant is dispensed in a mixture with a carrier gas,
wherein the mixture is sprayed onto the two working rollers exclusively on a run-out side of a rolling pass, the run-out side being where the rolled material runs out of the roll gap; and
wherein the coolant is dispensed onto the at least one of the two working rollers and the rolled material exclusively on a run-in side of the rolling pass, the run-in side being where the rolled material runs into the roll gap.

2. The method as claimed in claim 1, wherein the lubricant is a lubricating oil.

3. The method as claimed in claim 1, wherein water is used as the coolant.

4. The method as claimed in claim 1, wherein a cooling emulsion is used as the coolant.

5. The method as claimed in claim 4, wherein the coolant contains at least one emulsifier, which improves the adhesion of the lubricant to at least one of the two working rollers and the rolled material.

6. The method as claimed in claim 1, wherein the mixture of the lubricant and the carrier gas is sprayed the rolled material when the rolled material is being guided through the roll gap in both rolling directions.

7. A method for rolling a rolled material, comprising:
guiding the rolled material alternatingly in a first and a second rolling direction through a roll gap between two working rollers of a reversing roll stand, the first rolling direction being opposite to the second rolling direction;
introducing a lubricant for lubricating a contact zone into the contact zone in which the rolled material bears against the working rollers;
applying a coolant to at least one of the working rollers and the rolled material;
wherein the lubricant is dispensed in a mixture with a carrier gas,
wherein the mixture is sprayed onto at least one of the working rollers and the rolled material exclusively on a run-out side of a rolling pass, the run-out side being where the rolled material runs out of the roll gap;
wherein the coolant is dispensed onto the at least one of the working rollers and the rolled material exclusively on a run-in side of the rolling pass, the run-in side being where the rolled material runs into the roll gap;
wherein the mixture of the lubricant and the carrier gas is sprayed onto at least one of the working rollers and the rolled material when the rolled material is being guided through the roll gap in the first rolling direction; and
wherein the mixture of the lubricant and the carrier gas is not sprayed onto at least one of the working rollers and the rolled material when the rolled material is being guided through the roll gap in the second rolling direction.

8. A method for rolling a rolled material, comprising:
guiding the rolled material alternatingly in two mutually opposite rolling directions through a roll gap between two working rollers of a reversing roll stand;
introducing a lubricant for lubricating a contact zone into the contact zone in which the rolled material bears against the two working rollers;
applying a coolant to at least one of the two working rollers and the rolled material;
wherein the lubricant is dispensed in a mixture with a carrier gas,
wherein the mixture is sprayed onto at least one of the two working rollers and the rolled material exclusively on a run-out side of a rolling pass, the run-out side being where the rolled material runs out of the roll gap;
wherein the coolant is dispensed onto the at least one of the two working rollers and the rolled material exclusively on a run-in side of the rolling pass, the run-in side being where the rolled material runs into the roll gap; and
wherein, when the rolled material is being guided through the roll gap for a first time, a rolled material head of the rolled material, which is a first region of the rolled material to be guided through the roll gap, is guided through the roll gap at a slower speed than the remaining region of the rolled material.

9. The method as claimed in claim 8, wherein, when the rolled material head is being guided through the roll gap for the first time, no coolant is dispensed onto the at least one of the two working rollers and onto the rolled material.

10. A rolling apparatus for rolling a rolled material, the rolling apparatus comprising:
a reversing roll stand with two working rollers;
at least one spraying bar on each side of the rolling stand configured to spray the mixture of the lubricant and the carrier gas onto the two working rollers;
at least one cooling bar configured to dispense the coolant onto at least one of the two working rollers and onto the rolled material; and
a controller is configured to control each spraying bar so that the mixture of the lubricant and the carrier gas is dispensed exclusively on the run-out side of the rolling pass;
wherein the controller is configured to control each cooling bar so that the coolant is dispensed exclusively on the run-in side of the rolling pass.

11. The rolling apparatus as claimed in claim 10, wherein all the spraying bars are arranged on a same side of the reversing roll stand.

12. The rolling apparatus as claimed in claim 10, wherein the at least one spraying bar and the at least one cooling bar are arranged on at least one side of the reversing roll stand.

13. The rolling apparatus as claimed in claim 10, wherein:

the at least one spraying bar is at least two spraying bars; and on at least one side of the reversing roll stand, a first one of the at least one spraying bars is arranged above a rolled material plane, in which the rolled material is guided, and a second one of the at least one spraying bars is arranged below the rolled material plane.

14. The rolling apparatus as claimed in claim 10, wherein, on at least one side of the reversing roll stand, at least one cooling bar is arranged above a rolled material plane, in which the rolled material is guided, and at least one cooling bar is arranged below the rolled material plane.

15. A rolling apparatus for rolling a rolled material, the rolling apparatus comprising:

a reversing roll stand with an upper working roller and a lower working roller, the upper working roller and the lower working roller defining a roll gap and having a first side from which the rolled material is rolled into and out of the reversing roll stand, and a second side opposite the first side;

two upper spraying bars configured to spray a mixture of a lubricant and a carrier gas onto at least the upper working roller, one of the two upper spraying bars being on the first side and the other of the two upper spraying bars being on the second side;

two lower spraying bars configured to spray the mixture of the lubricant and the carrier gas onto at least the lower working roller, one of the two lower spraying bars being on the first side and the other of the two lower spraying bars being on the second side;

two upper cooling bars configured to dispense a coolant onto at least one of the upper working roller and the rolled material, one of the two upper cooling bars being on the first side and the other of the two upper cooling bars being on the second side;

two lower cooling bars configured to dispense a coolant onto at least one of the lower working roller and the rolled material, one of the two lower cooling bars being on the first side and the other of the two lower cooling bars being on the second side; and a controller is configured to control each spraying bar so that the mixture of the lubricant and the carrier gas is dispensed exclusively on a run-out side of a rolling pass, the run-out side being where the rolled material runs out of the roll gap;

wherein the controller is configured to control each cooling bar so that the coolant is dispensed exclusively on a run-in side of the rolling pass, the run-in side being where the rolled material runs into the roll gap.

16. The rolling apparatus as claimed in claim 15, wherein the rolling apparatus is configured to perform a method for rolling a rolled material, the method comprising:

guiding the rolled material alternatingly in two mutually opposite rolling directions through the roll gap;

spraying the mixture of the lubricant and the carrier gas onto at least the upper working roller and the lower working roller; and dispensing the coolant onto at least one of the upper working, the lower working roller, and the rolled material.

17. The rolling apparatus as claimed in claim 15, wherein, when the rolled material is being guided through the roll gap for a first time, a rolled material head of the rolled material, which is a first region of the rolled material to be guided through the roll gap, is guided through the roll gap at a slower speed than the remaining region of the rolled material.

* * * * *